US008356929B2

(12) United States Patent
Zaugg et al.

(10) Patent No.: US 8,356,929 B2
(45) Date of Patent: Jan. 22, 2013

(54) TIMEPIECE MOVEMENT WITH A KARUSSEL

(75) Inventors: Alain Zaugg, Le Brassus (CH); Jan Pittet, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 12/582,295

(22) Filed: Oct. 20, 2009

(65) Prior Publication Data

US 2010/0103782 A1 Apr. 29, 2010

(30) Foreign Application Priority Data

Oct. 23, 2008 (EP) ..... 08167430

(51) Int. Cl.
*G04B 15/00* (2006.01)
*G04B 19/20* (2006.01)

(52) U.S. Cl. ..... 368/127; 368/140

(58) Field of Classification Search ..... 368/127–133, 368/140

See application file for complete search history.

(56) References Cited

U.S. PATENT DOCUMENTS

| | | | | |
|---|---|---|---|---|
| 4,717,260 | A * | 1/1988 | Tsuji | 368/21 |
| 5,608,694 | A * | 3/1997 | Grimm et al. | 368/127 |
| 7,008,102 | B2 * | 3/2006 | Taillard et al. | 368/127 |
| 7,527,423 | B2 * | 5/2009 | Ruchonnet et al. | 368/127 |
| 7,568,831 | B2 * | 8/2009 | Greubel et al. | 368/127 |
| 7,815,363 | B2 * | 10/2010 | Buttet et al. | 368/124 |
| 2005/0232085 | A1 * | 10/2005 | Scheufele | 368/37 |
| 2006/0221775 | A1 * | 10/2006 | Zaugg | 368/127 |

FOREIGN PATENT DOCUMENTS

| | | |
|---|---|---|
| CH | 256590 A | 8/1948 |

* cited by examiner

*Primary Examiner* — Sean Kayes
(74) *Attorney, Agent, or Firm* — Sughrue Mion, PLLC

(57) ABSTRACT

The timepiece movement (1) includes a karussel (4) whose platform carries an escape wheel that cooperates with a balance (7). The platform is driven from the time display mechanism associated with a time-setting mechanism (32). The escape wheel is driven directly from the gear train. In addition to compensating for differences in rate due to gravity, the karussel of the invention proposes a new, complementary role: that of time indicator.

9 Claims, 7 Drawing Sheets

TIMEPIECE MOVEMENT WITH A KARUSSEL

The present invention relates to a timepiece movement that includes a karussel formed of a platform carrying an escape wheel and pallets that cooperate with a sprung-balance, a gear train meshed with a transmission wheel carried by a barrel, and a time display mechanism, derived from said gear train, wherein the display mechanism is associated with a time-setting mechanism.

The accepted meaning of a timepiece "karussel" is a regulating system, generally made up of a conventional assortment and a balance as shown for example in the work, "Théorie d'Horlogerie" by C. -A. Reymondin et al. (FET, CH-1347 Le Sentier, 1998, pages 167 and 168). These elements are placed on a platform that is used as a base and pivots between a platform bridge and a bottom plate. Here, the platform operates like a seconds wheel set. It is secured to a seconds pinion and driven by a third wheel. The role of the escapement on the platform is conventional. The force is transmitted from an escape pinion that meshes, like a planetary wheel, with a stationary seconds wheel secured to the bottom plate. In this well known embodiment, the balance staff is at some distance from the platform staff and from a first side thereof, whereas the escape wheel staff is at some distance from the platform staff but from a second side thereof, opposite the first side.

The balance and its bridge may be considered to rotate like a wooden horse on the platform of a carousel. The use of the term "karussel" is thus clear. The karussel, just like the tourbillon from which it is derived, makes the sprung balance take all vertical positions. This automatically compensates for any differences in rate, which improves timing.

The conventional karussel that has just been described is generally mounted in a timepiece that has a gear train, which meshes with a transmission wheel carried by a barrel. Finally, this known movement includes a time display mechanism, which is derived from the gear train, and the display mechanism is associated with a time-setting mechanism.

The movement of the present invention also includes a karussel that has the advantage described above of automatically compensating for rate differences due to gravity exerted on the sprung balance of the timepiece. Further, the movement also proposes to make the karussel platform play a second part: that of time indicator.

Thus, in order to achieve this object, in addition to complying with the statement of the first paragraph of this description, this invention is original in that first and second means are implemented for respectively driving the platform from the time display mechanism, and the escape wheel from the gear train.

Figure 1:
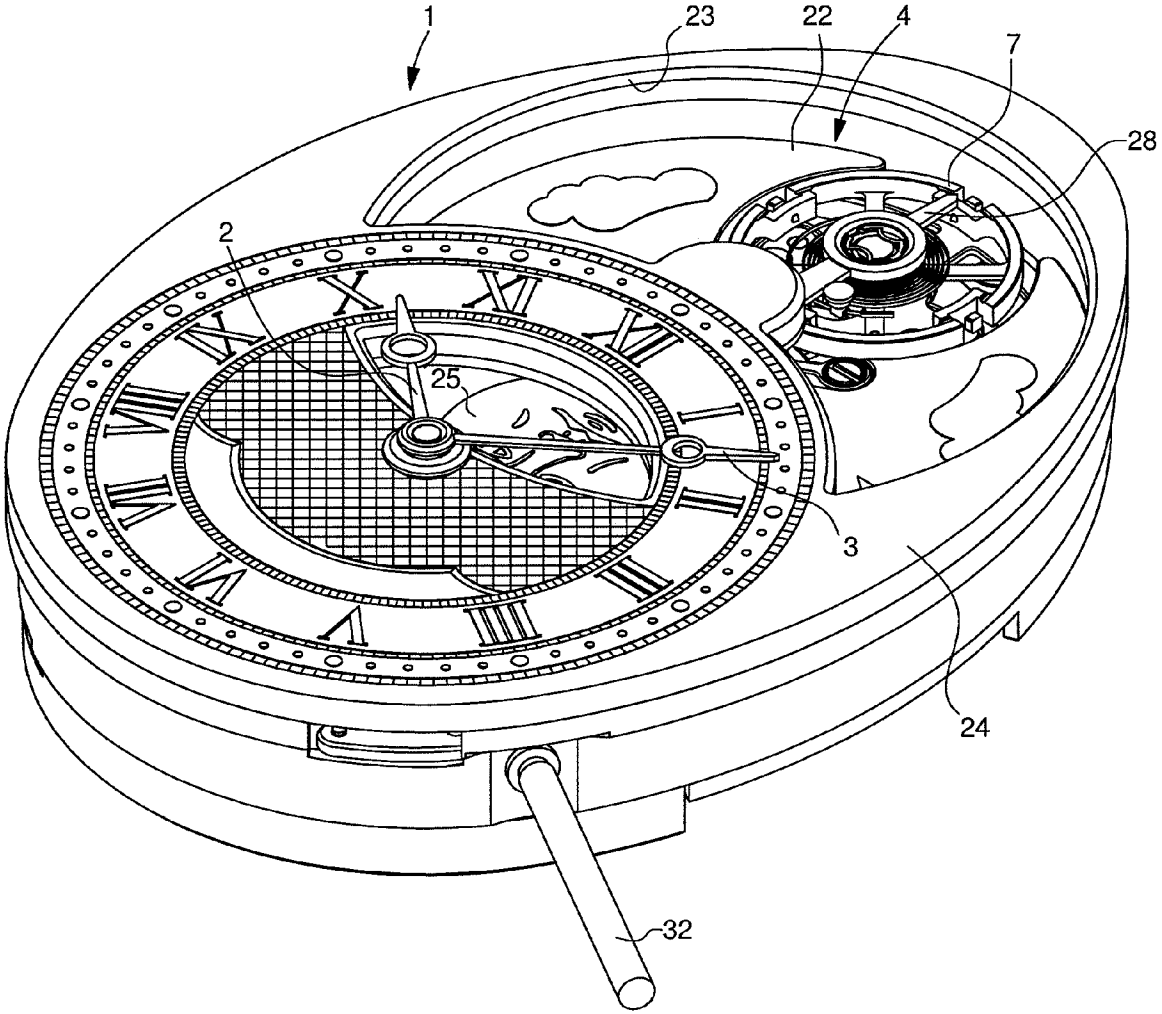
Figure 2:
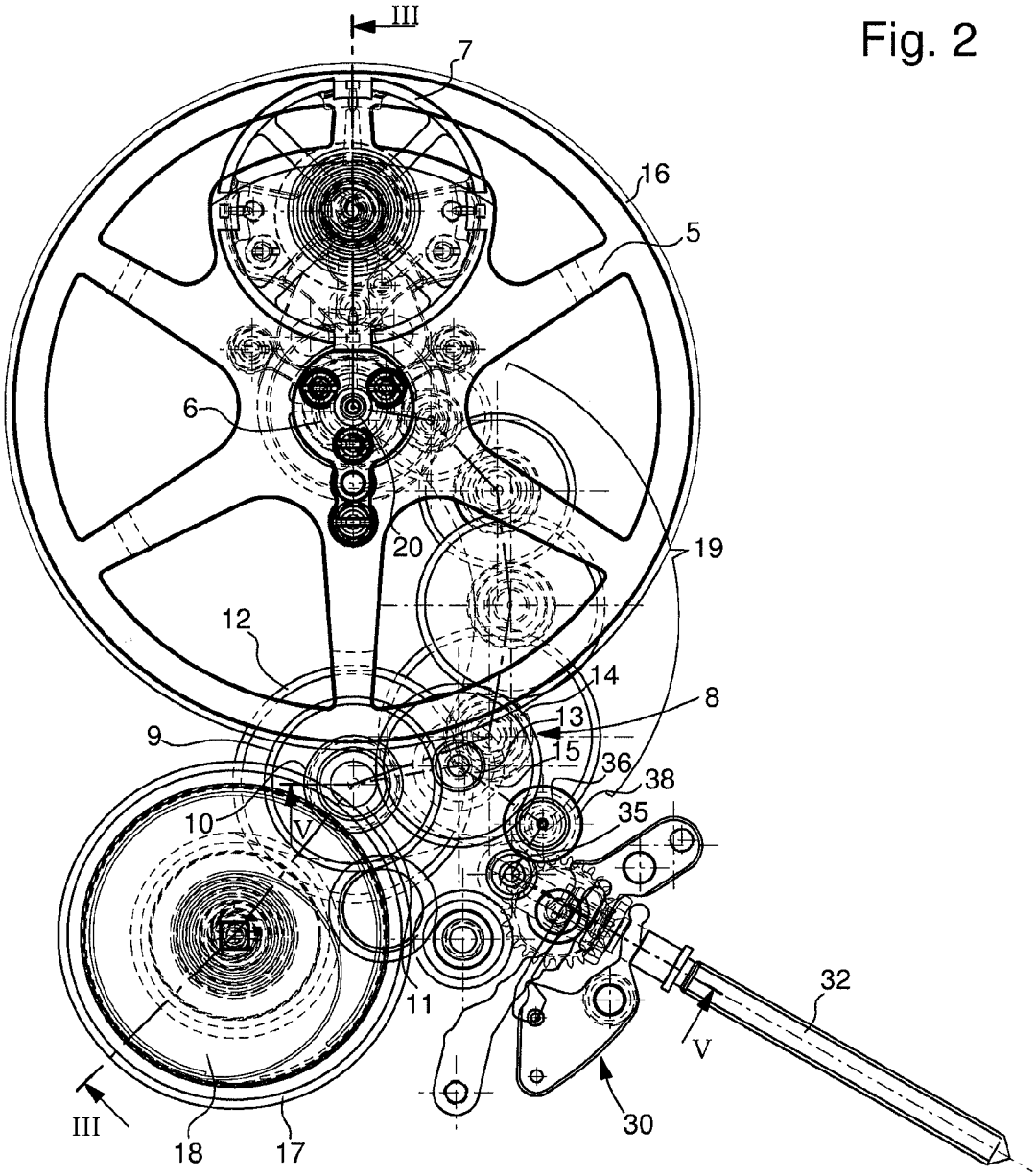
Figure 3:
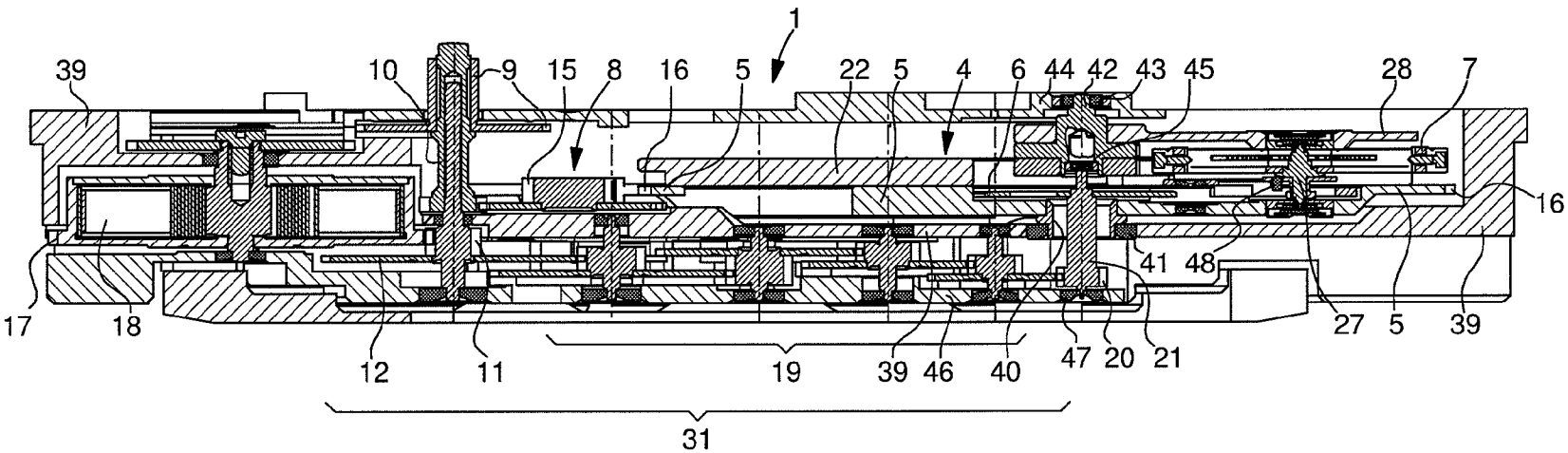
Figure 4:
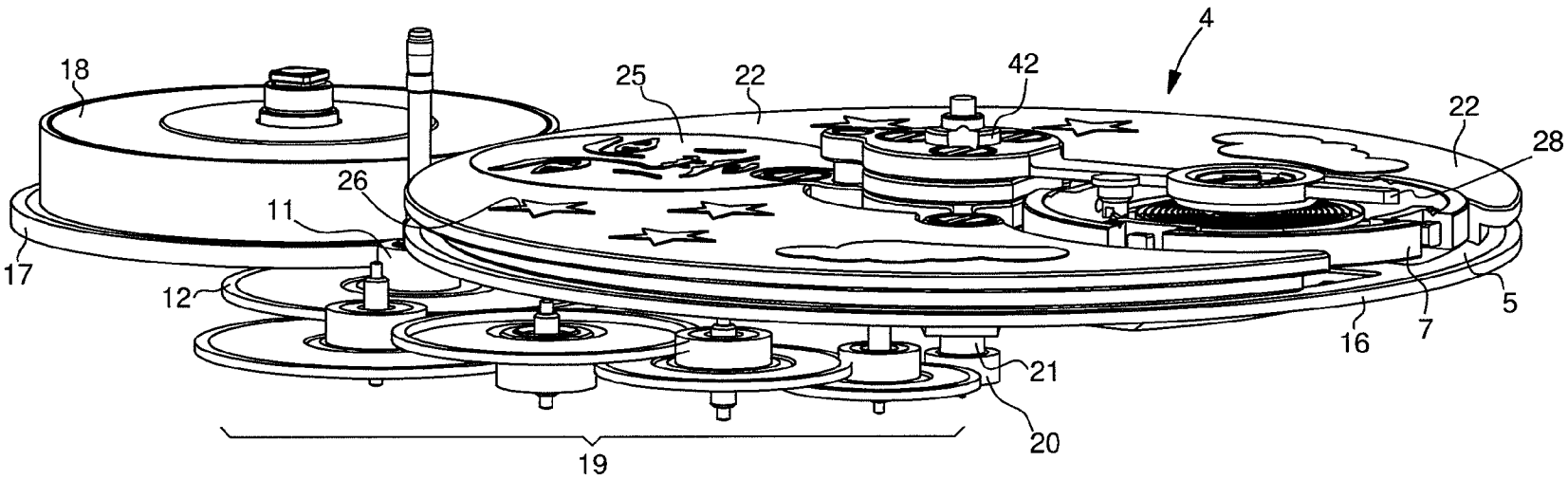
Figure 5:
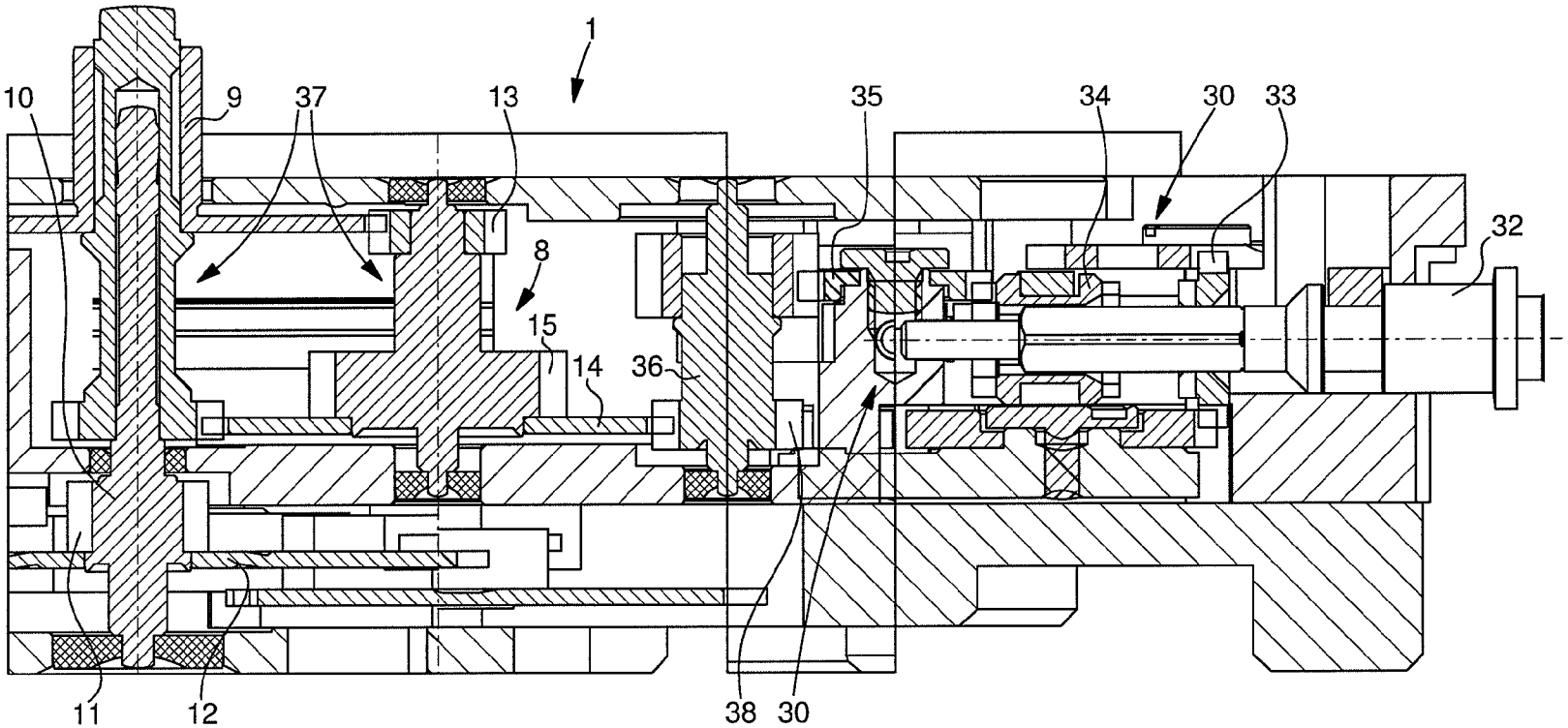
Figure 6:
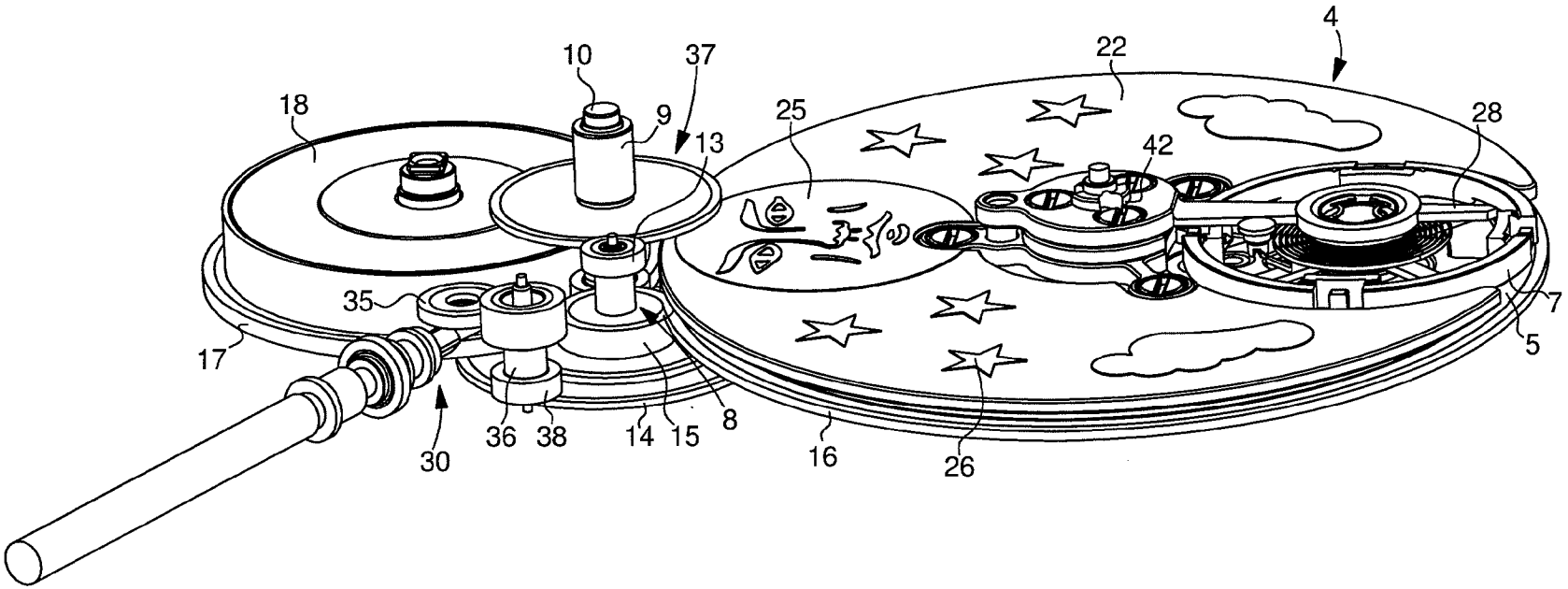
Figure 7:
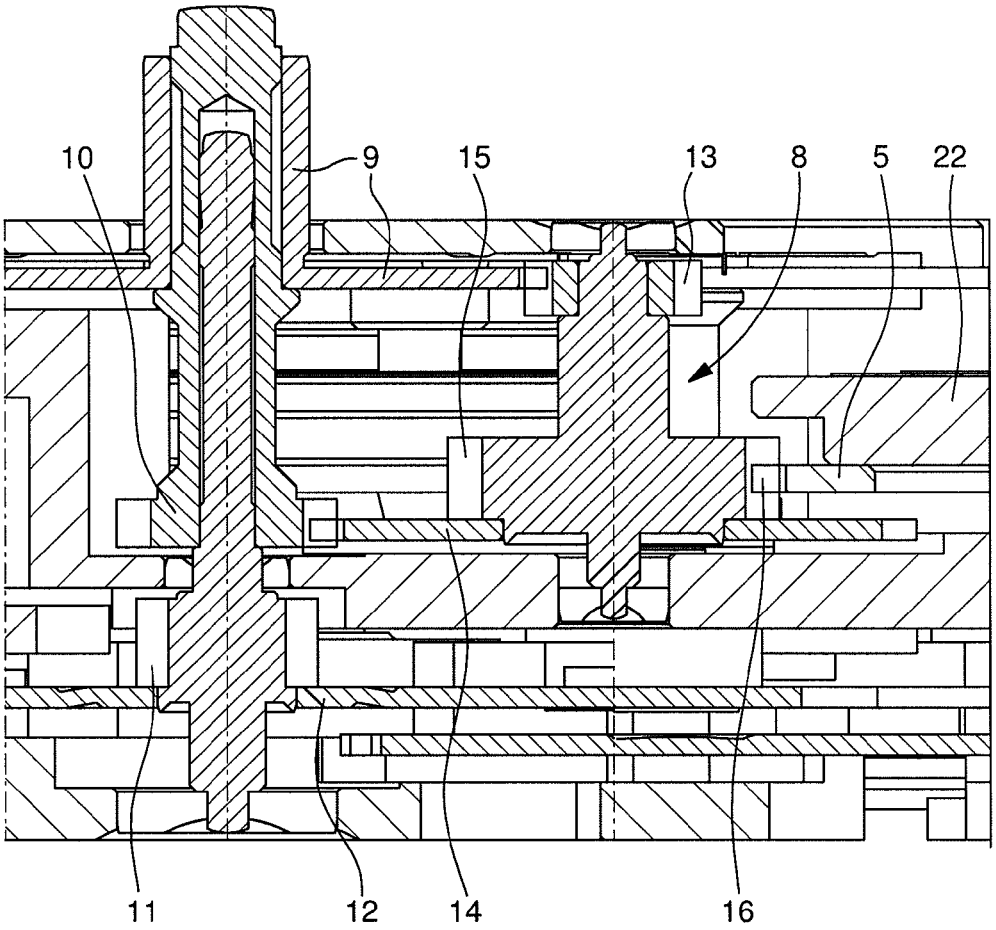

The invention will now be explained in detail below via an embodiment given by way of non-limiting example, this embodiment being illustrated by the annexed drawings, in which:

FIG. 1 is a perspective view of the timepiece that includes the movement of the invention, FIG. 2 is a plan view of the entire mechanism contained in the timepiece shown in FIG. 1, FIG. 3 is a cross-section along the line III-III shown in FIG. 2, FIG. 4 is a perspective view of the mechanism shown in cross-section in FIG. 3, FIG. 5 is a cross-section along the line V-V shown in FIG. 2, FIG. 6 is a perspective view of the mechanism shown in cross-section in FIG. 5, and FIG. 7 is a cross-Section of the plate being driven from the hands.

As the Figures show, the movement of timepiece 1 includes a karussel 4. This karussel is formed of a platform 5 carrying an escape wheel 6 that cooperates with a sprung balance 7. A gear train 31 is meshed with a transmission wheel 17 carried by a barrel 18, as shown clearly in FIG. 3. The movement further includes a time display mechanism 37 derived from gear train 31, and the mechanism is associated with a time-setting mechanism 30, as is shown in FIG. 5. A time display mechanism will be described in detail below.

According to the invention, first means are implemented for driving platform 5 from time display mechanism 37. This is fundamentally new. Indeed, if one wishes to make karussel 4 play the part of a time indicator, in addition to the conventional role consisting in correcting errors in rate due to gravity, as stated above, it must be possible to set the time of said indicator when the time of hour indicator 2 and minute indicator 3 is set. This does not occur in the conventional karussel, in which the gear train drives the platform, which is separate from time display mechanism 37. In fact, in this invention, the display train, which is linked to the time indicator hands, drives platform 5.

Again according to the invention, second means are implemented for driving escape wheel 6 from gear train 31 as is explained in FIG. 3 and described below. It should be noted that "gear train" means the set of wheels and pinions, which, from barrel 18, transmit the drive force to escape wheel 6.

As can be seen in FIGS. 5 and 6, time display mechanism 37 used here is not new. It includes an hour wheel 9 carrying an hour hand or indicator 2—see FIG. 1—and a cannon-pinion 10 carrying a minute hand or indicator 3—see FIG. 1. Hour wheel 9 and cannon-pinion 10 are connected kinematically by a motion wheel set 8.

More specifically, as shown in FIGS. 5 to 7, motion wheel set 8 includes a first pinion 13 meshed with hour wheel 9. This wheel set also includes a wheel 14 meshed with cannon-pinion 10. In addition, motion work 8 includes a second pinion 15, which is new and which is arranged for driving a toothing 16, which is secured to platform 5 and arranged at the periphery thereof, as shown in FIGS. 3, 6 and 7.

As stated above, motion wheel set 8 is associated with time-setting mechanism 30. This latter comprises, amongst other things and in a known manner, a time-setting stem 32—which is also the winding stem—, a winding pinion 33, a sliding pinion 34, a first, intermediate, motion wheel 5, and a second, intermediate, motion wheel 36, which is meshed with motion wheel set 8 by a pinion 38 geared to wheel 14 of motion work 8.

Platform 5 is pivotably mounted on bottom plate 39 of timepiece 1. As FIG. 3 shows, on one side of the platform a pipe 40 is driven into said platform 5. This pipe penetrates a jewel 41 secured to bottom plate 39 and can rotate inside the jewel. On its other side, platform 5 carries a bridge 28 of balance 7 which in turn carries a pivot 42 that rotates inside a jewel 43 carried by a bridge 44 secured to bottom plate 39.

In this embodiment, escape wheel 6 is located at the centre of rotation of platform 5. This wheel 6 is carried by an arbour 21 that passes through pipe 40. Arbour 21 pivots in a jewel 45 carried by pivot 42 and in a jewel 47 carried by a train bar 46. Escape wheel 6 cooperates directly with pallets (not shown in the drawing) whose fork cooperates with an impulse pin 48, while the roller is carried by arbour 27 of balance 7. Arbour 27 of balance 7 pivots in platform 5 and in balance bar 28, the latter being used, as will be seen below, as a twenty-four hour indicator.

Returning now to gear train 31, which was mentioned above, it will be observed that at the start of development the train has a centre pinion 11 that meshes directly with transmission wheel 17 carried by barrel 18. As FIG. 3 shows clearly, cannon-pinion 10 is fitted onto centre pinion 11 in a push fit manner. Centre pinion 11 is fitted with a centre wheel 12, meshed with a gear train 19, which in turn drives escape wheel 6 via a pinion 20 carried by arbour 21 onto which said escape wheel 6 is fitted. Gear train 19 is made up of several wheel sets that pivot in bottom plate 39 and in train bar 46 which was mentioned above.

It will be noted here that the invention is not limited to a gear train that includes a centre pinion. If, for example, one wished to provide the movement with a centre seconds indicator, the gear train would have to include a centre pinion and a third wheel before the meshing of the seconds pinion.

It was stated above that, in addition to compensating for rate differences due to gravity, the karussel of the invention proposes a new, complementary role: that of time indicator. One embodiment of this invention proposes a twenty-four hour time display, although other times could be envisaged.

It will be specified here that a twenty-four hour display in the form of a disc has already been proposed, for example in CH Patent No 671 317 where a disc displaying the diurnal and nocturnal periods appearing through a dial is driven by the hour wheel of the timepiece. This is not, however, a karussel disc.

To achieve this display, the transmission ratio resulting from the gearing of second pinion 15 of motion wheel set 8 on toothing 16 of platform 5 is selected such that platform 5 makes one revolution in twenty-four hours.

In this case, and as stated above, balance 7, carried by its arbour 27 which pivots both in platform 5 and in balance bar 28, uses the bar as a twenty-four hour indicator. The balance bar is thus used as a twenty-four hour hand that moves opposite markings made on the dial or case of the timepiece.

To complete the foregoing, platform 5 may be surmounted by a decoration 22 from which balance 7 emerges. As FIG. 1 shows, this decoration 22 may appear partially through at least one aperture 23 made at twelve o'clock in dial 24 of timepiece 1.

FIGS. 1, 4 and 6 also show that platform 5 and its decoration 22 show, through aperture 23 of dial 24, the periods of day and night. Here, balance 7 shows the sun, i.e. the light part of the day. The side opposite the balance carries on decoration 22 a moon 25 and stars 26, which represent the night period of the day.

It was stated above that one embodiment of the invention proposes placing escape wheel 6 at the centre of rotation of platform 5, which is not the custom of known karussels, where the balance and the escape wheel are diametrically opposite. A centred escape wheel leads to an increase in the diameter of the platform, which is favourable from the point of view of the timepiece's attractiveness, especially if it is a timepiece of oval shape.

What is claimed is:

1. A timepiece movement include a karussel formed of a platform carrying an escape wheel that cooperates with a sprung balance, a gear train meshed with a transmission wheel, carried by a barrel, and a time display mechanism including a minute wheel set and derived from said gear train, wherein said display mechanism is associated with a time-setting mechanism, wherein first means are implemented for driving the platform from the time display mechanism, said first means including said minute wheel set, wherein second means are implemented for driving the escape wheel, said second means including the gear train and wherein said escape wheel is driven by said gear train and said platform is driven through a cannon-pinion connection; and the escape wheel is not driven through a cannon-pinion connection.

2. The movement according to claim 1, wherein the escape wheel is located at the centre of rotation of the platform.

3. The movement according to claim 1, wherein the gear train includes a centre pinion fitted with a centre wheel, which is meshed with a gear train driving the escape wheel via a pinion carried by an arbour onto which said escape wheel is fitted.

4. The movement according to claim 1, wherein the motion wheel set includes a first pinion meshed with the hour wheel, a wheel meshed with the cannon-pinion, and a second pinion arranged for driving a toothing secured to and arranged at the periphery of the platform.

5. The movement according to claim 4, wherein the transmission ratio resulting from the meshing of the second pinion of the motion work on the toothing of the platform is selected such that the platform makes one revolution in twenty-four hours.

6. The movement according to claim 5, wherein the balance is carried by an arbour that pivots both in the platform and in a balance bar, said balance bar being used as a twenty-four hour indicator.

7. The movement according to claim 6, wherein the platform is surmounted by a decoration from which the balance emerges, said decoration appearing partially through at least one aperture made at 12 o'clock in the dial of the timepiece.

8. The movement according to claim 7, wherein the platform and its decoration reveal through the aperture of the dial the diurnal and nocturnal periods of the day, the balance representing the sun and the part opposite the balance carrying, on the decoration, a moon and stars representing the nocturnal period of the day.

9. The movement according to claim 1, wherein the time display mechanism includes an hour wheel carrying an hour indicator and a cannon-pinion carrying a minute indicator, the hour wheel and the cannon pinion being connected by a motion wheel set.

* * * * *